United States Patent [19]

Phillips

[11] Patent Number: 4,601,102

[45] Date of Patent: Jul. 22, 1986

[54] GUARD FOR SKINNING KNIFE

[76] Inventor: Robert W. Phillips, Rte. 1, Box 142, Clermont, Fla. 32711

[21] Appl. No.: 674,496

[22] Filed: Nov. 23, 1984

[51] Int. Cl.[4] ..... B26B 29/00

[52] U.S. Cl. ..... 30/123.5; 30/286; 17/21

[58] Field of Search ..... 30/123.5, 216, 272 A, 30/286; 17/21

[56] References Cited

U.S. PATENT DOCUMENTS

| | | | |
|---|---|---|---|
| 525,737 | 9/1894 | Foster | 30/286 |
| 1,299,084 | 4/1919 | Wilson | 17/21 X |

FOREIGN PATENT DOCUMENTS

| | | | |
|---|---|---|---|
| 570025 | 4/1924 | France | 17/21 |
| 1506572 | 4/1978 | United Kingdom | 30/286 |

*Primary Examiner*—E. R. Kazenske
*Assistant Examiner*—Willmon Fridie, Jr.
*Attorney, Agent, or Firm*—Macdonald J. Wiggins

[57] ABSTRACT

A guard for the cutting edge of a knife used in slitting, eviscerating and skinning of game and the like. A concave, arcuate body includes a longitudinal slot normal to the concave body for accepting the forward cutting edge of a knife blade. The forward end of the slot tapers to a wedge shape for accepting the point of the blade and the rear end tapers to a wedge shaped slot to form a friction fit with the rear portion of the cutting edge leaving only a short exposed cutting edge. A rear portion of the body is concave and provides a thumb rest for the user. A rear edge guard is pivotally attached to the proximal end of the guard and may be swung forward for short blades and rearward to cover the rear portion of long blades.

4 Claims, 8 Drawing Figures

GUARD FOR SKINNING KNIFE

BACKGROUND OF THE INVENTION

1. Field of the Invention

The present invention relates to skinning of animals such as game and the like, and more particularly to a guard to be used with a skinning knife in slitting, evisceration and skinning animals in a safe, fast and non-destructive manner.

2. Description of the Prior Art

Hunters commonly carry sheath knives or case knives with highly sharpened blades for use in slitting, evisceration and skinning game. When the animal hide is to be slit, in preparation for evisceration and skinning it is necessary for only a shallow cut be made to prevent destruction of the animal flesh and to minimize accidental puncture or slitting of the viscera. It is also necessary that some means be provided to prevent accidental cuts to the hunter from the knife. Thus, the use of a sheath knife or case knife for slitting and skinning requires considerable care and skill on the part of the user. It is thus desirable that some means be provided to ensure a shallow cut and to prevent injury. Although special knives have been proposed for skinning, these are commonly used by butchers and are powered. For example, U.S. Pat. No. 2,830,368 to Knoll et al shows a skinning knife having a reciprocating cutting blade. Similarly, Prohaska teaches in U.S. Pat. No. 2,596,078 a serrated blade knife in which the blade reciprocates. A hunter's knife is shown in the U.S. Pat. No. Des. 262,731 to Austin but provides no guard nor means for controlling the depth of cut. A tool which may be used by butchers and hunters which provides some degree of safety is shown in U.S. Pat. No. 2,778,054 to Whittaker. The device includes a folding hinge like portion which opens out when in use and includes a notch for accepting the point of the knife. However, the device is not securely attached to the knife and does not provide as much protection as desired. A guard for a surgical knife blade which limits the depth of cut is described in the Beaver patent, U.S. Pat. No. 3,945,117. None of the above mentioned devices are suitable for the purposes of the present invention.

SUMMARY OF THE INVENTION

My invention is a compact, adjustable guard device for knives used in slitting, evisceration and skinning animals such as game. In one embodiment of the invention, a body portion of the guard has a forward arcuate section and a shorter contiguous arcuate rear section. The forward section terminates in a smooth rounded point while the juncture of the front and rear sections includes a saddle horn element. A longitudinal slot through the forward section extends from the front face of the saddle horn element and to the blunt point. The slot is sufficiently wide to permit the cutting edge of a knife to be inserted therethrough. The forward end of the slot narrows at the point portion to accept the knife point and grips the knife point by means of a wedge like construction. Similarly, the slot adjacent the saddle horn portion includes a wedge type slot which engages a rearward portion of the knife cutting edge. With a knife blade inserted in the slot as described above, the rear arcuate portion of the guard provides a resting point for the user's thumb while the hand grips the handle of the knife in a conventional fashion. A second edge guard is pivotally attached to the proximal end of the rear arcuate portion and is formed to cover either the rear portion of the cutting edge of a long knife or to engage the finger guard on a short blade knife as will be described in more detail hereinafter. By virtue of the pivoted construction of the rear edge guard, it may be adjusted to fit most knives. When the guard of the invention is not in use, the rear edge guard folds forward for stowing of the invention in a pocket or case.

In use, the knife guard is installed on the knife to be used in a slitting and skinning operation with the result that the sharp point of the knife is enclosed and only a short forward portion of the cutting edge edge of the knife projects from the guard. The user may then safely hold the knife with the guard in place and proceed to cut, with forward motion and away from user, the desired slits in the hide of the animal with assurance that cut will be made only to the required depth. As the guarded knife blade is moved along the skin, there will only be a minimum amount of fat and tissue below the skin cut which will greatly reduce damage to flesh and will prevent puncture of any of the entrails. Thus, as may be seen, damage to the muscular tissue of the game and possible contamination due to viscera puncture is prevented. Since the point and entire cutting edge of the knife which is not actually being used during the slitting operation is covered, the operation is safe for the user since the guard will prevent accidental injury.

It is therefore a principal object of my invention to provide a simple and effective guard for the cutting edge of a knife used for slitting, evisceration and skinning game.

It is another object of my invention to provide a low cost knife blade guard that can be carried in the user's pocket or belt case and can be attached to almost any type of knife used for skinning game.

It is still another object of my invention to provide a skinning knife guard which will cover the point and cutting edges of a knife except for a small portion which is used for slitting the skin of the game and which can then be grasped firmly by the user without danger of self-injury.

It is still another object of my invention to provide a cutting edge guard for a knife used for skinning game which will control the depth of cut to prevent damage to the animal's muscle tissue and viscera.

These and other objects and advantages of my invention will become apparant from the following detailed description when read in conjunction with the drawings.

DETAILED DESCRIPTION OF THE PREFERRED EMBODIMENT

Figure 1:
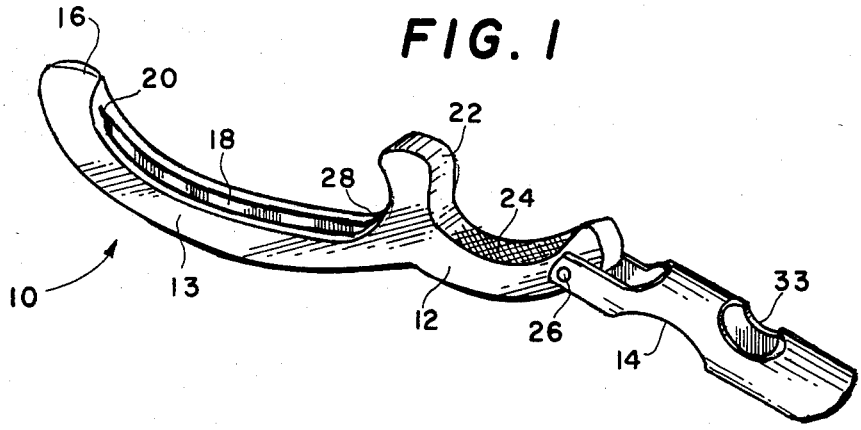
FIG. 1 is a perspective view of the knife guard of my invention in which the rear edge guard is shown in an open position.

Referring to FIG. 1, a perspective view of the knife guard 10 of my invention is shown. Although the guard 10 may be made from various materials, I prefer metal such as brass, aluminum, or steel. The guard 10 includes a body portion 12 having a forward arcuate section 13 and a rear arcuate section 15. The forward or distal end of forward section 13 terminates in a blunt point 16 while the proximal end terminates in a saddle horn element 22. Extending rearward from saddle horn 22 is an arcuate proximal section 15 having a thumb saddle 24 formed therein. Saddle 24 may be knurled to present a non-slip surface. A folding rear edge guard 14 is pivotally attached to the proximal end of rear element 15 and is in an unfolded position in FIG. 1. Edge guard 14 includes an opening 33 for engaging saddle horn 22 as will be explained hereafter.

Forward element 13 has a longitudinal slot 18 therethrough with the forward end of slot 18 terminating in a wedge type slot 20 and the rearward end terminating in a wedge type slot 28, the slots to be describd in more detail hereinafter.

Figure 2:
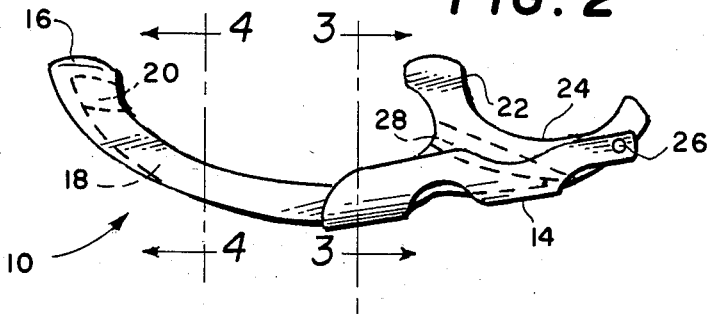
FIG. 2 is a side view of the guard of FIG. 1 in which the rear edge guard is folded for carrying or stowing.
Figure 5:
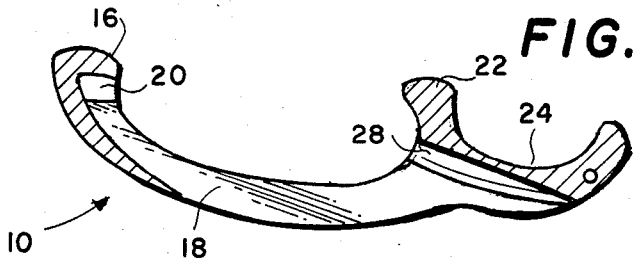
FIG. 5 is a cross-sectional view of the body portion of the knife guard of FIG. 1.
Figure 3:
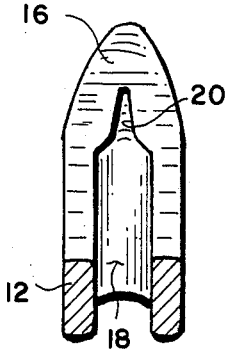
FIG. 3 is a cross-sectional view through the plane 3—3 of FIG. 2 of my knife guard showing the rear wedge slot.
Figure 4:
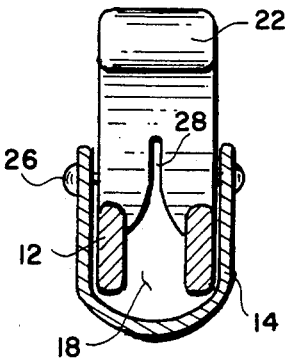
FIG. 4 is a cross-sectional view of the distal portion of my knife guard showing the wedge slots accepting the tip of a knife.

Turning now to FIG. 2, a side view of the guard 10 is shown in which edge guard 14 has been folded in position for carrying the guard in the pocket or in a case. Slot 18 is indicated by dashed lines while front wedge slot 20 and rear wedge slot 28 are also shown by dashed lines. FIG. 3 is a cross-sectional view of the guard 10 in plane 4—4 of FIG. 2 which shows the shape of forward wedge slot 20. As can be seen, the point and adjacent sharp edge of a knife will fit into slot 20 and by virtue of the tapered sidewalls thereof will be wedged therein. Similarly, rear wedge slot 28 shown in cross-section through plane 3—3 of FIG. 2 in FIG. 4 (and also in FIG. 5) permits the sharpened edge of a knife to become wedged therein. As may also be seen from FIG. 5, the tip of the knife is guarded by slot 20 which serves as a safety feature to prevent accidental injury to the user.

Figure 6:
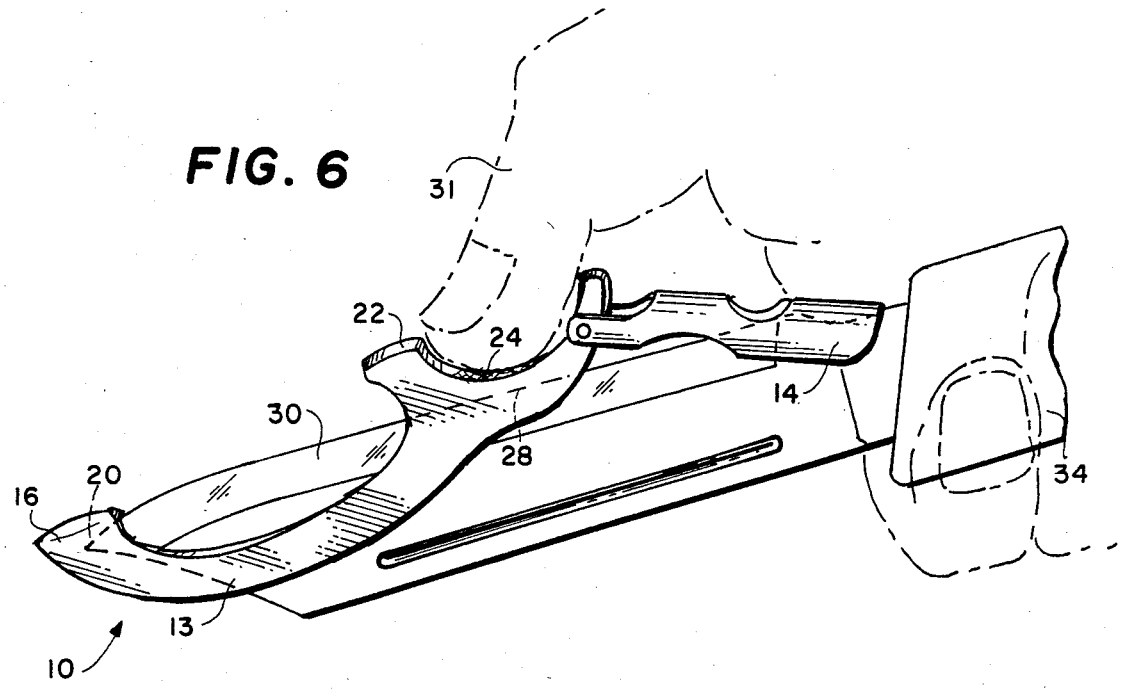
FIG. 6 is a perspective view of the invention in place on the blade of a large case knife in which the rear edge guard is being used.

Having described the construction of my knife guard, the installation thereof for use will be described with reference to FIGS. 7 and 8. In FIG. 6, guard 10 is shown installed on a large case knife 34 having a blade 30. As will be seen, the tip of blade 30 is wedged into forward wedge slot 20 and a rearward portion of blade 30 is wedged into rear wedge slot 28. Advantageously, wedge slots 20 and 28 tend to hold the guard 10 securely in place, minimizing any tendency for it to slip off during use. In the example of FIG. 6, the cutting edge of 35 of knife 34 extends rearward from the body portion 13 of guard 10 and therefore edge guard 14 is swung in the position shown so as to guard against accidental contact with the knife edge 35. During a slitting or skinning operation, the user places thumb 31 in saddle 24 to maintain the guard 10 in solid contact with blade edge 35 during such operations.

After a slit is made in the hide with the knife 34 as shown, the blunt point 16 is used to press the flesh downward thereby feeding the hide onto the blade edge 30 for cutting. As the blade is pushed forward, away from the user, the point 16 serves to separate the hide from the flesh. It may be noted that the blade 30 advantageously tends to cut the hide from the inside out, giving the user greater control.

In the event that a clean cut is not made, the hide will contact saddle horn 22, alerting the user to back up slightly to make a proper cut.

Figure 7:
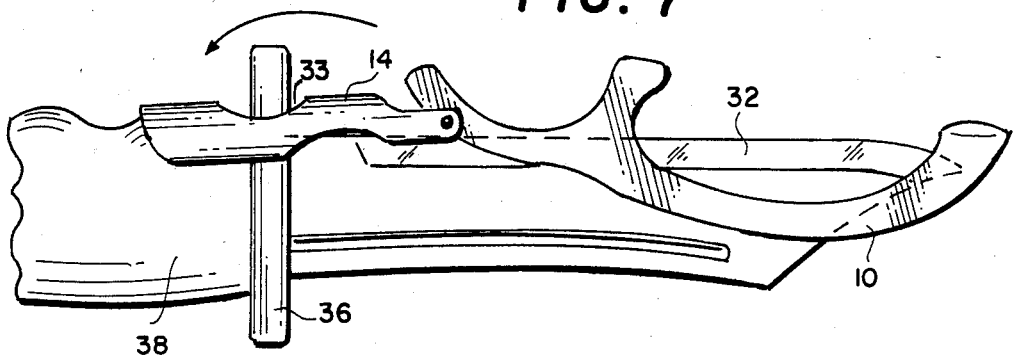
FIG. 7 is a view showing the knife guard in place on a short sheath knife in which the rear edge guard engages the finger guard of the knife.
Figure 8:
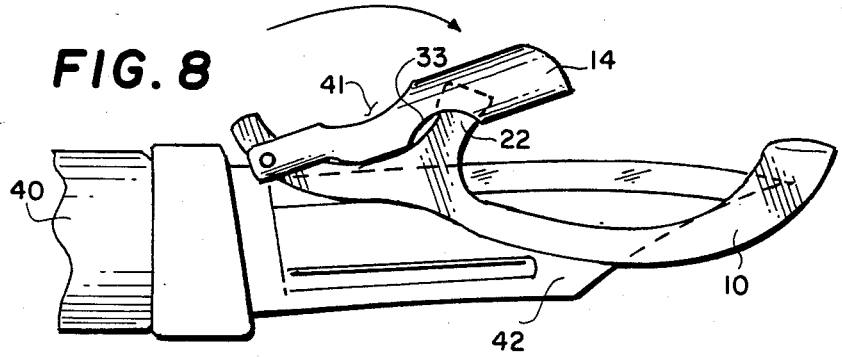
FIG. 8 is a view of a short knife in which the rear edge guard is folded over the saddle horn.

In FIG. 7, a short sheath knife is shown with guard 10 in place on blade edge 32. In this case, edge guard 14 has been moved in the direction of the arrow so as to capture finger guard 36 in opening 33. FIG. 8 illustrates the use of my knife guard with a short bladed knife 40. Here, the rear section 15 guards the cutting edge 43 adjacent the user. Rear edge guard 14 is not required and is folded forward as indicated by the arrow with opening 33 engaging saddle horn 22. The user then rests the thumb in recess 41.

Having shown in detail the construction of the preferred embodiment of my knife guard, it will become apparent that the device can be manufactured in any desired style and from any suitable material. I have found that a length of body 12 of about 4 inches and an overall length with the edge guard extended of about 6 inches will permit the guard to be used with a very large percentage of knives used for slitting and skinning. However, it is to be understood that the device can be tailored to fit almost any outsized or unusual design knife blade without departing from the spirit and scope of my invention. Materials such as wood, fiberglass, plastics or a mixture of such materials may be used in the construction of a knife guard in accordance with my invention.

I claim:

1. A guard device for knives being used in slitting, evisceration, and skinning of animals comprising:

a body having a forward arcuate section and a contiguous arcuate rearward section;

a blunt point at the distal end of said forward section;

a saddle horn portion of said body forming a juncture between said forward section and said rearward section, said forward section having a concave surface between said point and said saddle horn portion, and said rearward section having a concave surface between said saddle horn portion and the rear end of said rearward portion;

said forward section having an elongate longitudinal slot therethrough normal to said concave surface for receiving the sharp edge of a knife blade, said slot narrowing to a wedge shape within said point for receiving the tip of said knife blade, said slot narrowing to an elongate wedge shape adjacent said saddle horn portion for gripping said sharp edge of said knife blade; and a rear knife edge guard pivotally attached to said rear end of said rearward section, said guard adjustable to cover the rear portion of the sharp edge of a knife blade and is pivotable forward to engage said body opposite said forward and rearward concave surfaces for stowage of said device;

whereby said knife blade has its tip and a rear portion of its sharp edge guarded by said device exposing only a short forward portion of its sharp edge and in which said concave surface of said rearward section of said device serves as a thumb rest for a user of said device.

2. The device as defined in claim 1 in which said device is formed from metal.

3. The device as defined in claim 1 in which said concave surface of said rearward section is knurled.

4. The device as defined in claim 1 in which said rear knife edge guard includes an opening therethrough, said guard pivotable forward toward said forward and rearward concave surfaces whereby said opening engages said saddle horn portion for use with a short bladed knife.

* * * * *